US008508201B2

(12) United States Patent
Kawashima

(10) Patent No.: US 8,508,201 B2
(45) Date of Patent: Aug. 13, 2013

(54) INDUCTOR DRIVING CIRCUIT

(75) Inventor: Hiroshi Kawashima, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 9 days.

(21) Appl. No.: 12/533,470

(22) Filed: Jul. 31, 2009

(65) Prior Publication Data

US 2010/0097043 A1 Apr. 22, 2010

(30) Foreign Application Priority Data

Oct. 22, 2008 (JP) ..... 2008-272472

(51) Int. Cl.
*G05F 1/44* (2006.01)
*G05F 1/45* (2006.01)

(52) U.S. Cl.
USPC ..... 323/282; 323/222; 323/290

(58) Field of Classification Search
USPC ..... 323/282, 290, 222, 328, 231–233, 323/247, 257
See application file for complete search history.

(56) References Cited

U.S. PATENT DOCUMENTS

| | | | | |
|---|---|---|---|---|
| 5,331,534 | A * | 7/1994 | Suzuki et al. | 363/20 |
| 6,930,472 | B2 * | 8/2005 | Ito et al. | 323/247 |
| 7,317,302 | B1 * | 1/2008 | Collins | 323/222 |
| 7,626,370 | B1 * | 12/2009 | Mei et al. | 323/282 |

FOREIGN PATENT DOCUMENTS

| | | | |
|---|---|---|---|
| JP | 59155906 | A | 9/1984 |
| JP | 62107527 | U | 7/1987 |
| JP | 1147815 | U | 10/1989 |
| JP | 2306603 | A | 12/1990 |
| JP | 634322 | U | 5/1994 |
| JP | 739249 | U | 7/1995 |
| JP | 742104 | U | 7/1995 |
| JP | 8149796 | A | 6/1996 |
| JP | 09-199324 | | 7/1997 |
| JP | 10184974 | A | 7/1998 |
| JP | 2001-132866 | | 5/2001 |
| JP | 2002-015916 | | 1/2002 |
| JP | 2003086422 | A | 3/2003 |
| JP | 2006308082 | A | 11/2006 |
| JP | 2008041908 | A | 2/2008 |

OTHER PUBLICATIONS

Japanese Office Action in Corresponding Application No. 2008-272472 with an English Translation.

* cited by examiner

*Primary Examiner* — Adolf Berhane
*Assistant Examiner* — Nusrat Quddus
(74) *Attorney, Agent, or Firm* — Kanesaka Berner & Partners LLP

(57) ABSTRACT

In an inductor driving circuit, a DC voltage is applied between a positive terminal and a negative terminal. A series connection of an inductor and a transistor is provided between the positive terminal and the negative terminal. A gate control circuit is configured to turn on the transistor in response to the application of the DC voltage and turn off the transistor in response to the stop of the application of the DC voltage. A diode is connected between a source and a drain of the transistor to have a cathode connected to the positive terminal and an anode connected to the negative terminal. A feedback diode has a cathode connected to the positive terminal and an anode connected to the negative terminal.

13 Claims, 9 Drawing Sheets

INDUCTOR DRIVING CIRCUIT

INCORPORATION OF REFERENCE

This application claims a priority on convention based on Japanese Patent Application No. 2008-272472. The disclosure thereof is incorporated herein by reference.

BACKGROUND OF THE INVENTION

1. Field of the Invention

The present invention relates to an inductor driving circuit for driving an inductor.

2. Description of Related Art

Generally, a solenoid having a simple structure and operable at a high speed has been used for a relay and an electromagnetic contactor. Particularly, a DC solenoid is often used from a viewpoint of easiness to handle. Here, attention should be paid on a surge generated when a power supply is turned off. When the power supplied to the solenoid is turned off, a counter electromotive voltage is generated in the solenoid, which causes generation of a surge. There is a danger that a surge may destroy a semiconductor switch or other components for controlling the power supply to the solenoid. Various measures have been proposed against such the surge, as described in Japanese Patent Application Publications (JP-A-Heisei 9-199324, related art 1; JP-P2001-132866A, related art 2; and JP-P2002-15916A, related art 3).

FIG. 1 shows an example of a driving circuit for driving a DC solenoid. A DC power supply DCPS is connected to a solenoid 100 via a switching element SW. When the switching element SW is turned on (i.e. power supply is turned on), a DC driving voltage is applied to the solenoid 100 and a DC current starts to flow. When the switching element SW it turned off. (i.e. power supply is turned off), application of the DC driving voltage stops. In the example of FIG. 1, a current circulating diode 110 is arranged in parallel to the solenoid 100. Here, the current circulating diode 110 has a cathode connected to a positive terminal of the power supply and an anode connected to a negative terminal thereof. Therefore, no current flows through the current circulating diode 110 when the power supply is turned on. However, when the power supply is turned off, a counter electromotive voltage is generated in the solenoid 100. At this time, a loop is formed by the solenoid 100 and the current circulating diode 110 and a circulation current flows as shown by an arrow in FIG. 1. Therefore, effects of a surge to the DC power supply DCPS and the switching element SW or other components are effectively reduced.

Here, energy of the circulation current generated after turning off the power supply is consumed as joule heat in all inductor (or coil) which drives the solenoid 100. Therefore, attenuation time before achieving sufficient attenuation of the circulation current is relatively long. In this case; a time from timing When power supplied to the solenoid 100 is turned off to timing when a physical contact connected to the solenoid 100 is turned off is elongated. That is, a delay in a mechanical operation to turn off the power supply is enlarged. It is not preferable from a viewpoint of operating a machine at high speed.

FIGS. 2 and 3 show other examples of the driving circuit. In the example of FIG. 2, a capacitor 121 and an attenuation resistor 122 are connected in series between the positive terminal and the negative terminal. In the example of FIG. 3, a varistor 130 is connected between the positive terminal and the negative terminal. In the examples of FIGS. 2 and 3, a relatively high voltage is generated in turning off the power supply and attenuation energy which depends of a product of the high voltage and a current is made larger. That is, a time to attenuate an inductor current after turning off the power supply is shortened. Meanwhile, it is concerned that an excessive voltage or other factors are caused to the DC power supply DCPS and the switching element SW by the high voltage.

SUMMARY

One object of the present invention is to provide a technique capable of attenuating an inductor current promptly after turning off a power supply in an inductor driving circuit for driving an inductor.

In an aspect of the present invention, an inductor driving circuit includes a positive terminal and a negative terminal, between which a DC voltage is applied; a series connection of an inductor and a transistor between the positive terminal and the negative terminal; a gate control circuit configured to turn on the transistor in response to the application of the DC voltage and turn off the transistor in response to the stop of the application of the DC voltage; a diode connected between a source and a drain of the transistor and having a cathode connected to the positive terminal and an anode Connected to the negative terminal; and a feedback diode having a cathode connected to the positive terminal and an anode connected to the negative terminal.

According to the present invention, the inductor current can be attenuated promptly after turning off a power supply in an inductor driving circuit for driving an inductor.

DESCRIPTION OF THE REFERRED EMBODIMENTS

Hereinafter, an inductor driving circuit according to the present invention will be described in detail with reference to the attached drawings.

First Embodiment (Configuration)

Figure 4:
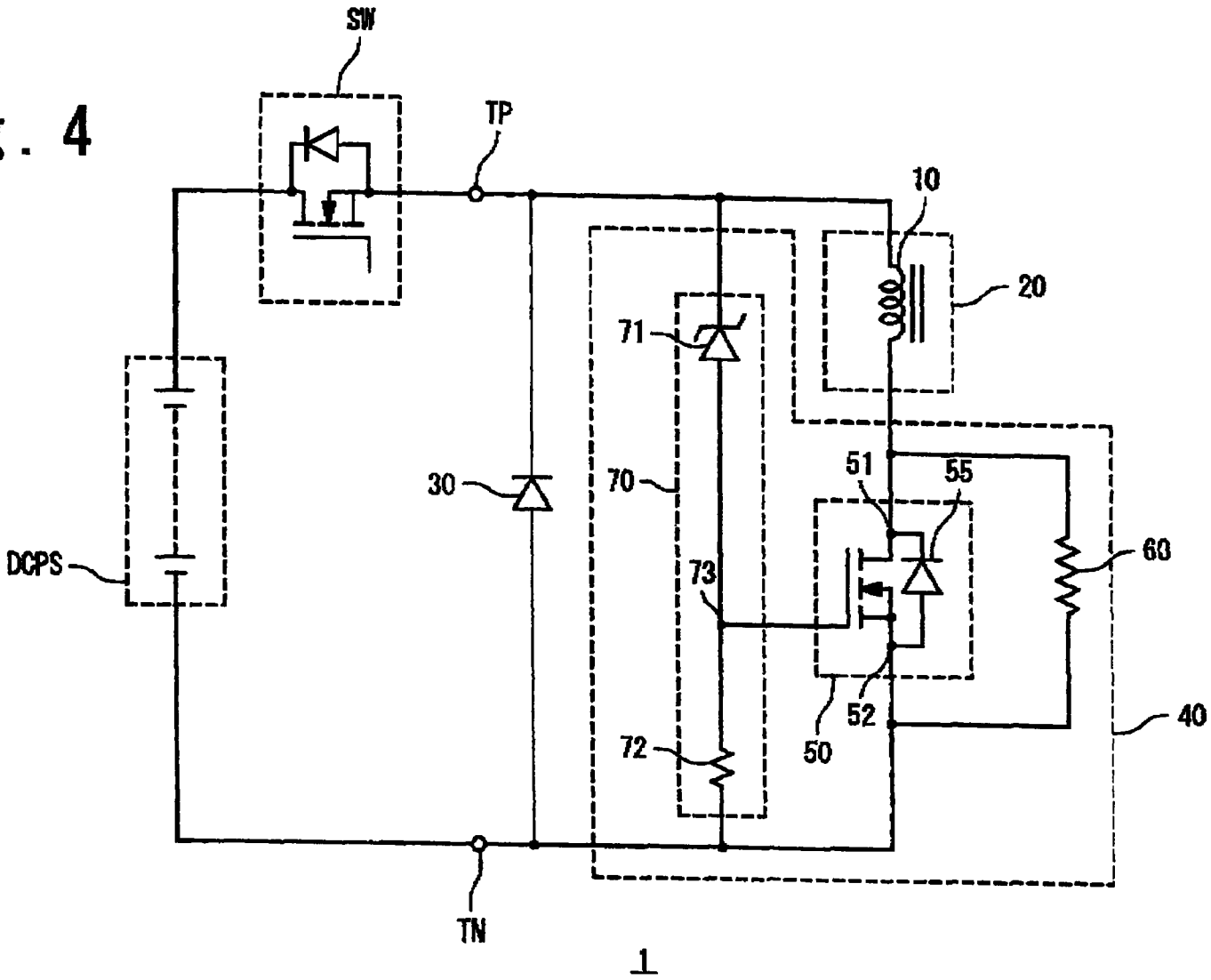
FIG. 4 is a circuit diagram showing configuration of an inductor driving circuit according to an embodiment of the present invention.

FIG. 4 is a circuit diagram showing a configuration of an inductor driving circuit 1 according to a first embodiment of the present invention. The inductor driving circuit 1 includes a DC power supply DCPS, a switching element SW, a positive terminal TP, a negative terminal TN, an inductive component 20 including an inductor 10, a current circulating diode 30, and a current attenuation circuit 40.

The DC power supply DCPS is connected to the positive terminal TP and the negative terminal TN. The switching element SW is interposed between the DC power supply DCPS and the positive terminal TP. The switching element SW is typically a semiconductor switch such as power MOSFET. When the switching element SW is turned on (i.e. power supply is turned on), a DC driving voltage is applied between the positive terminal TP and the negative terminal TN. When the switching element SW is turned off (i.e. the power supply is turned off), application of a DC driving voltage stops.

The inductive component 20 is a part component using the inductor (or coil) 10. Examples of the inductive component 20 include a solenoid, a relay, an electromagnet, an electromagnetic contactor, and a solenoid valve. In FIG. 4, the inductor 10 is connected to the positive terminal TP.

The current circulating diode 30 is connected between the positive terminal TP and the negative terminal TN. Here, the current circulating diode 30 has a cathode connected to the positive terminal TP and an anode connected to the negative terminal TN. Therefore, no current flows through the current circulating diode 30 when the power supply is turned on.

The current attenuation circuit 40 is used to attenuate a current flowing through the inductor 10 rapidly after turning off the power supply. More particularly, the current attenuation circuit 40 includes a power MOSFET 50, an attenuation resistor 60 and a gate control circuit 70.

The power MOSFET 50 and the above inductor 10 are connected in series between the positive terminal TP and the negative terminal TN. In the example of FIG. 4, the power MOSFET 50 is of an N-channel type, having a drain terminal 51 of the power MOSFET 50 connected to the positive terminal TP and a source terminal 52 of the power MOSFET 50 connected to the negative terminal TN. The power MOSFET 50 also has a build-in diode 55 which has been produced to realize source-drain connection. That is, the built-in diode 55 is connected between the drain terminal 51 and the source terminal 52 in the power MOSFET 50. The built-in diode 55 has a cathode connected to the drain terminal 51 and an anode connected to the source terminal 52. A source-drain breakdown voltage in the power MOSFET 50 is determined by an avalanche voltage in the built-in diode 55.

The attenuation resistor 60 is connected between the drain terminal 51 and the source terminal 52 in the power MOSFET 50.

The gate control circuit 70 turns on the power MOSFET 50 in response to turning on the power supply and turns off the power MOSFET 50 in response to turning off the power supply. In the example of FIG. 4, the gate control circuit 70 includes a constant voltage diode (or zener diode) 71 and a resistor 72. The constant voltage diode 71 and the resistor 72 are connected in series between the positive terminal TP and the negative terminal TN. A node arranged between the constant voltage diode 71 and the resistor 72 is a connection node 73. The constant voltage diode 71 has a cathode connected to the positive terminal TP and an anode connected to the connection node 73. The resistor 72 is connected between the connection node 73 and the negative terminal TN. This connection node 73 is then connected to a gate terminal in the power MOSFET 50.

(Operation in Turning on the Power Supply)

Figure 5:
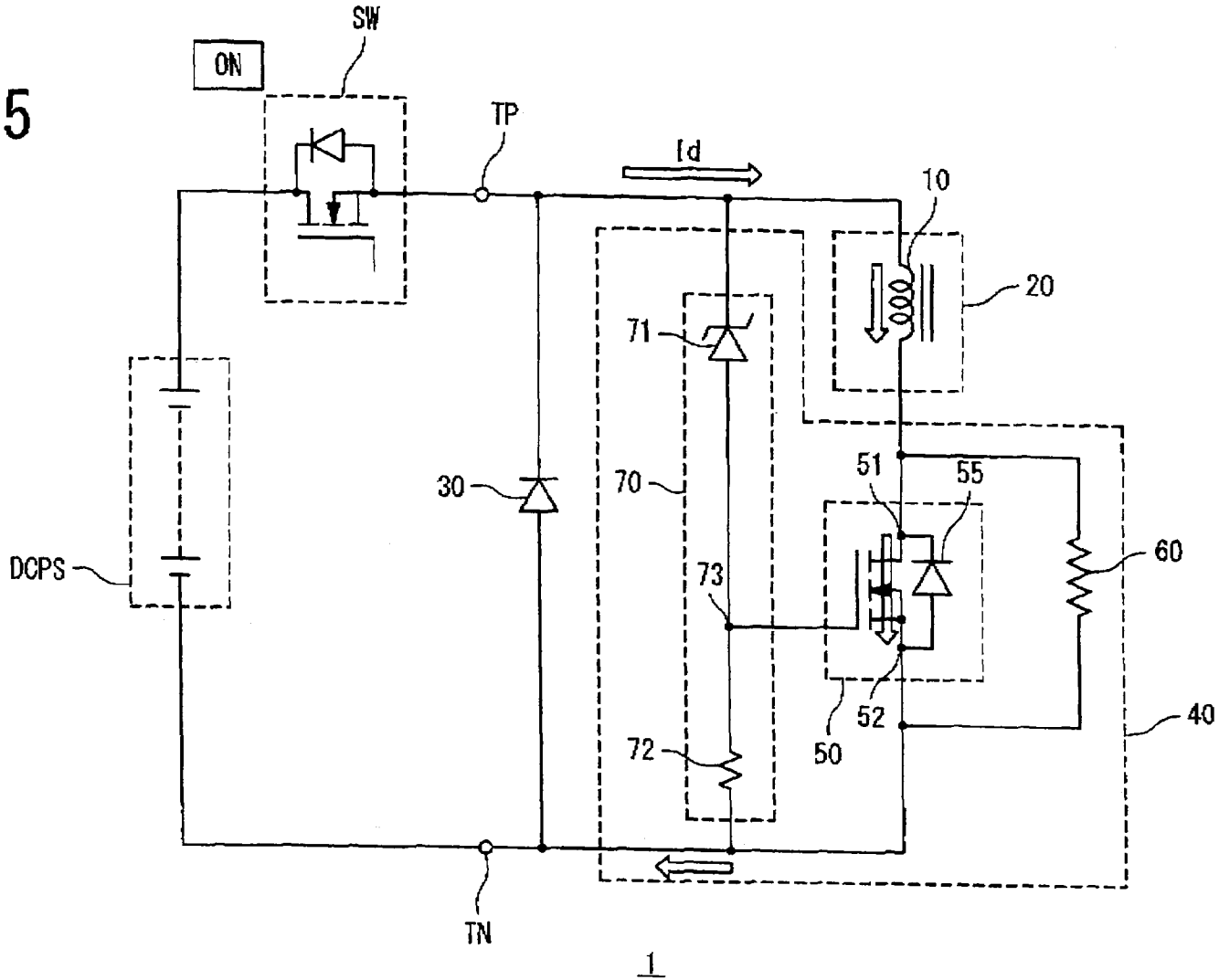
FIG. 5 is a diagram showing an operation of the inductor driving circuit in turning on a power supply.

An operation of the inductor driving circuit 1 in turning on the power supply will be described with reference to FIG. 5. When the power supply is turned on, a DC driving voltage is applied between the positive terminal TP and the negative terminal TN. A voltage obtained by subtracting a voltage across the constant voltage diode (or zener diode) 71 from a power supply voltage on the positive terminal TP is applied to the connection node 73 in the gate control circuit 70. The voltage on the connection node 73 is applied to the gate terminal of the power MOSFET 50 so as to turn on the power MOSFET 50 in a short period of time. As a result, a DC driving current Id flows from the positive terminal TP to the negative terminal TN through the inductor 10 and the power MOSFET 50, as shown by an arrow in FIG. 5. At this time, since an ON resistance of the power MOSFET 50 is small, no current substantially flows through the attenuation resistor 60. Accordingly, both the power MOSFET 50 and the attenuation resistor 60 are almost free from loss. The inductive component 20 using the inductor 10 is mechanically operated, resulting from the DC driving circuit Id flowing through the inductor 10.

(Operation in Turning Off the Power Supply)

Figure 1:
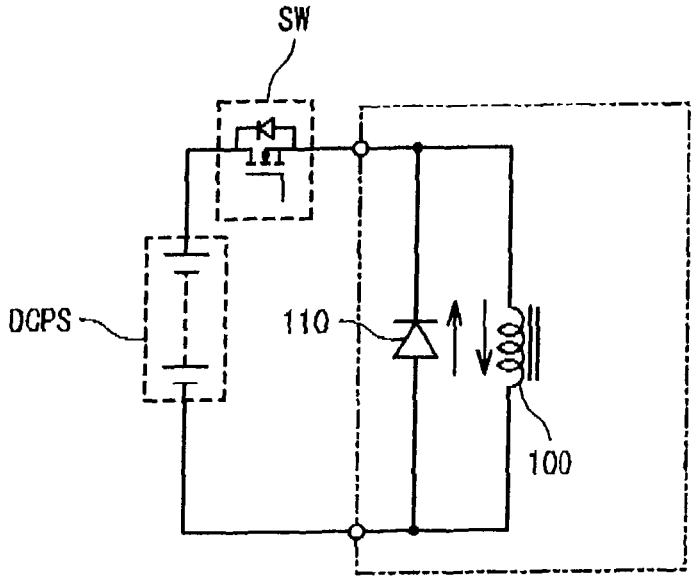
Fig. 1 RELATED ART
FIG. 1 is a circuit diagram showing a first conventional solenoid driving circuit.
Figure 2:
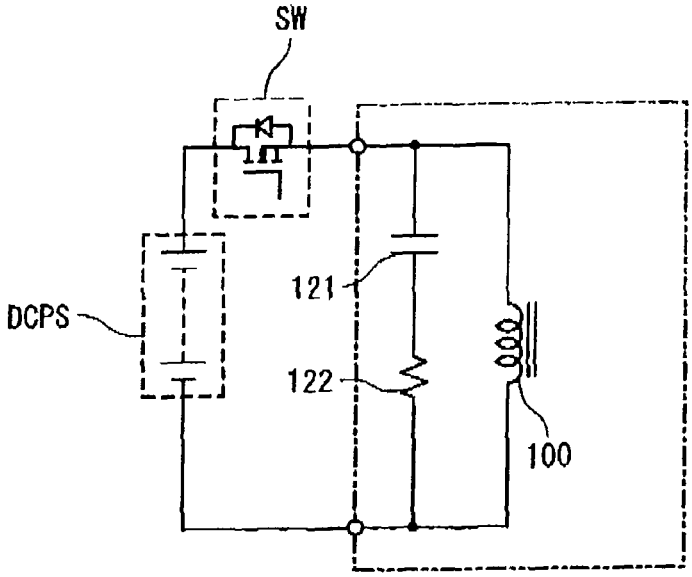
Fig. 2 RELATED ART
FIG. 2 is a circuit diagram showing a second conventional solenoid driving circuit.
Figure 3:
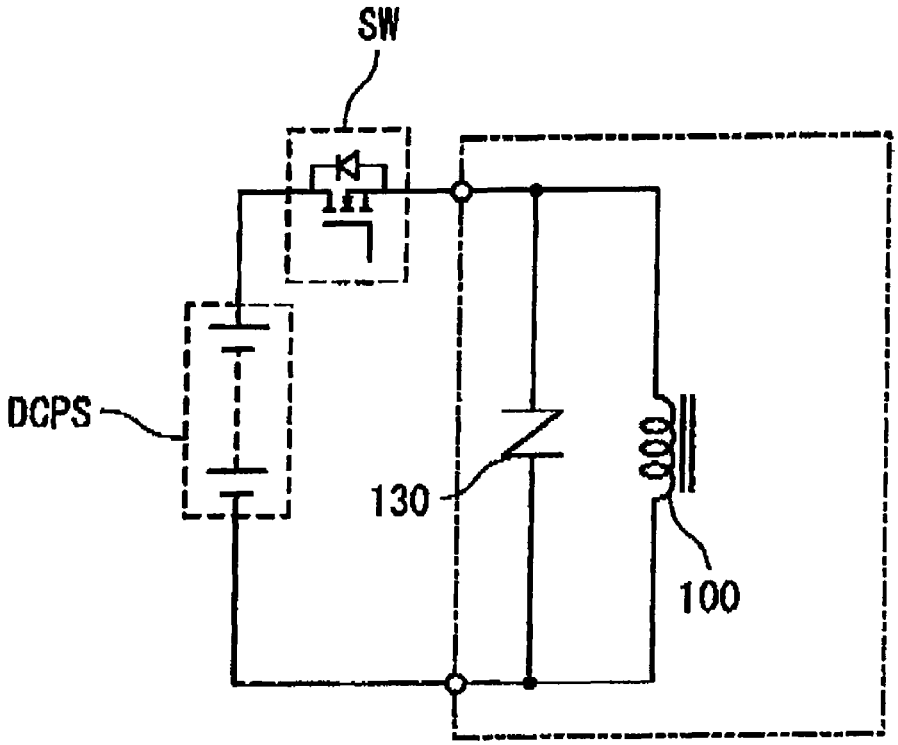
Fig. 3 RELATED ART
FIG. 3 is a circuit diagram showing a third conventional solenoid driving circuit.
Figure 6:
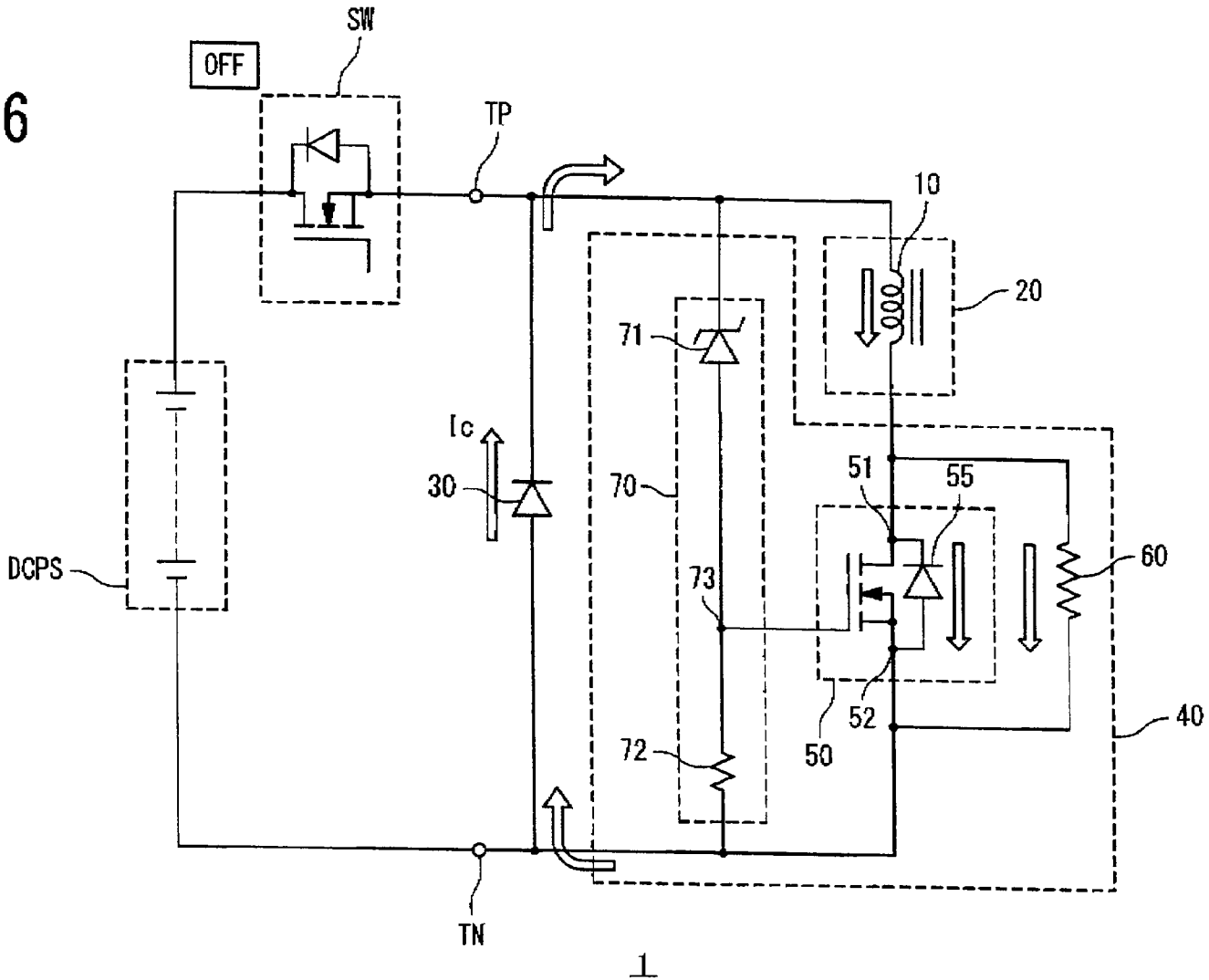
FIG. 6 is a diagram showing an operation of the inductor driving circuit after turning off the power supply.

Next, an operation of the inductor driving circuit 1 in turning off the power supply will be described with reference to FIG. 6. When the power supply is turned off, the application of the DC driving voltage stops. At this time, a counter electromotive voltage is generated in the inductor 10. According to the present embodiment, the current circulating, diode 30 is arranged as stated above. Accordingly, a circulation loop is produced by the current circulating diode 30 in the same manner as the case of FIG. 1. As a result, a circulation current Ic flows as shown by an arrow in FIG. 6. Therefore, effects of a surge to the DC power supply DCPS and the switching element SW or other components can be effectively reduced.

The current attenuation circuit 40 will operate as follows. When the power supply is turned off, the voltage on the connection node 73 in the gate control circuit 70 decreases. As a result, the power MOSFET 50 is turned off. More particularly, a voltage difference between the source terminal 52 of the power MOSFET 50 and the constant voltage diode 71 is about −1.5V. For this reason, gate electric charges of the power MOSFET 50 move through the constant voltage diode 71 and the power MOSFET 50 is turned off.

When the power MOSFET 50 is turned off, the circulation current Ic flows through the attenuation resistor 60 and is attenuated by it. At this time, the flow of the circulation circuit Ic through the attenuation resistor 60 generates a high voltage between both ends across the attenuation resistor 60. Attenuation energy in the attenuation resistor 60 depends on a product of the high voltage and the circulation current Ic. A value of the high voltage is also determined based on a product of a resistance value of the attenuation resistor 60 and the circulation current Ic flowing through the attenuation resistor 60. The attenuation resistor 60 has the resistance value which is designed so that the high voltage does not exceed an allowable breakdown voltage in the inductor 10.

If the above-described high voltage exceeds an avalanche voltage for breakdown voltage) of the built-in diode 55 of the power MOSFET 50, avalanche breakdown occurs in the built-in diode 55. As a result, energy of the circulation current Ic is consumed through avalanche absorption by the built-in diode 55 as well. That is, loss is observed in both of the attenuation resistor 60 and the built-in diode 55, and the circulation circuit Ic is attenuated rapidly.

It should be noted that at this time, a maximum value of the voltage between the drain terminal 51 and the source terminal 52 corresponds to an avalanche voltage in the built-in diode 55. A larger avalanche voltage makes faster attenuation of the circulation current Ic possible. Therefore, in order to achieve the maximum attenuation, it is preferable to select the power MOSFET 50 with a withstand voltage as high as possible without exceeding the allowable withstand voltage of the inductor 10.

(Effects)

According to the present embodiment, the current circulating diode 30 is arranged. Therefore, a circulation loop is produced by the current circulating diode 30 in turning off the power supply, and the circulation current Ic flows as shown in FIG. 6. As a result, effects of a surge to the DC power supply DCPS and the switching element SW or other components can be effectively reduced.

According to the present embodiment, the current attenuation circuit 40 is arranged. Therefore, the circulation current Ic is attenuated rapidly after turning off the power supply. An attenuation time until attenuating the circulation current Ic sufficiently is reduced substantially in comparison with the case of FIG. 1. Accordingly, the time from timing at which the power supply to the inductor 10 is turned off to timing at which a physical contact using the inductive component 20 is turned off is reduced.

Figure 7:
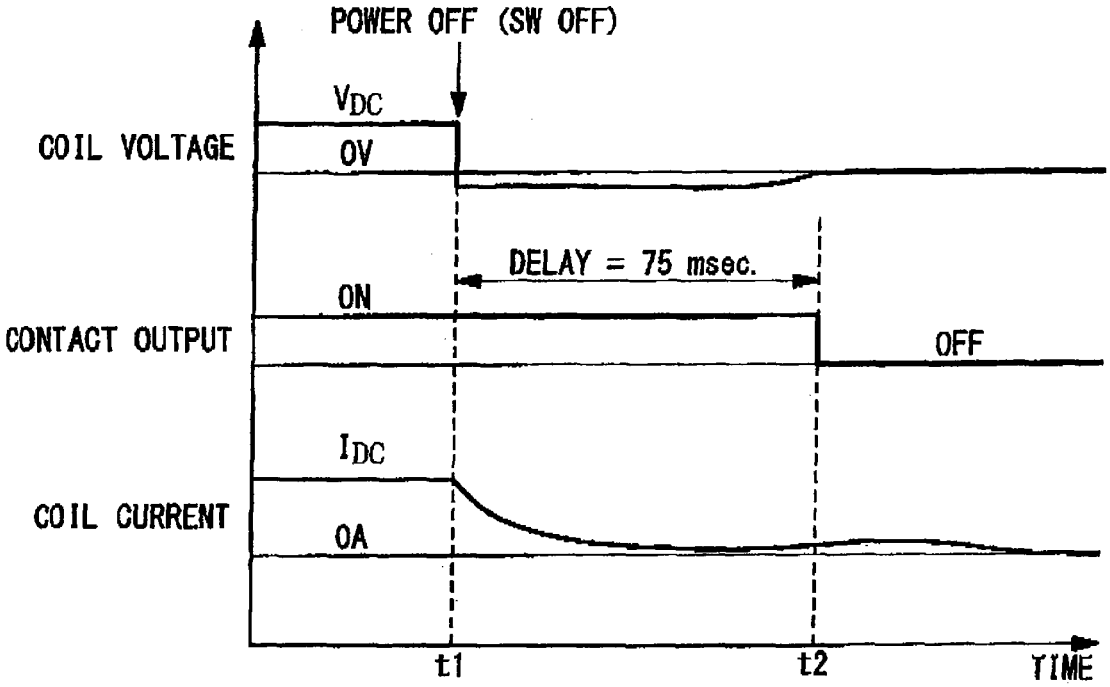
FIG. 7 is a graph diagram showing a state in turning off the power supply in a comparison example.
Figure 8:
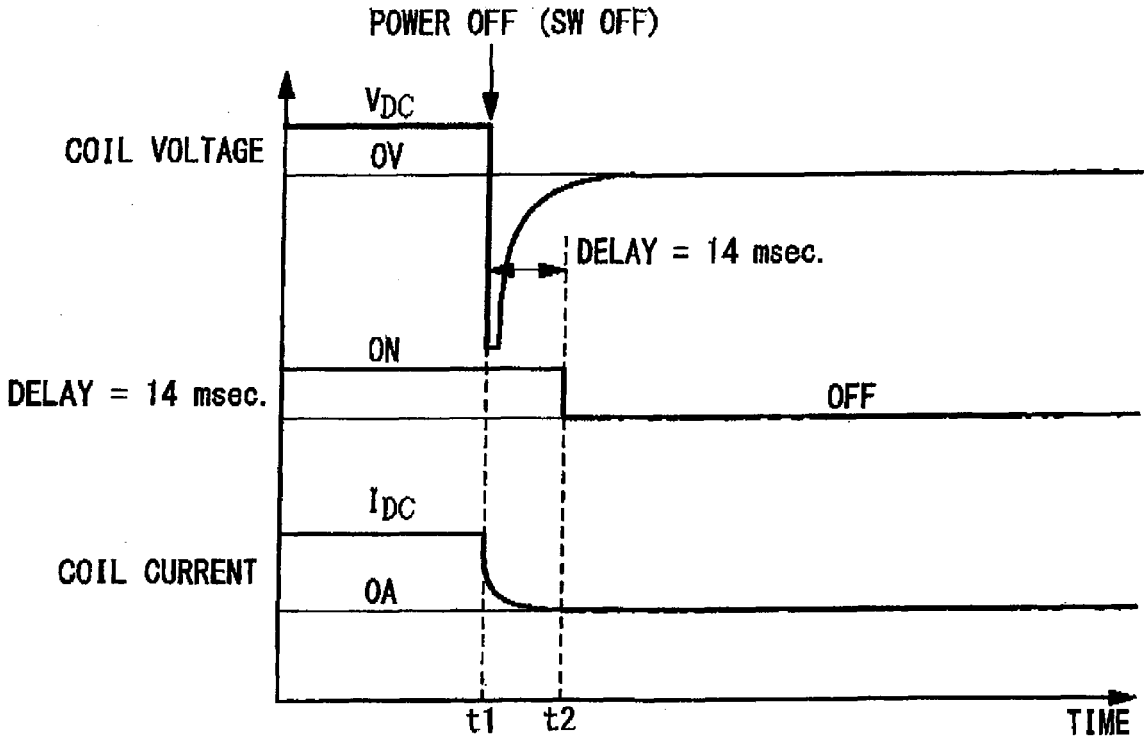
FIG. 8 is a graph diagram showing a state in turning off the power supply according to the present embodiment.

FIGS. 7 and 8 each shows a state of a coil voltage, a physical contact output, and a coil current in turning off the power supply. FIG. 7 shows a case without arranging the current attenuation circuit 40 as a comparison example. In contrast, FIG. 8 shows a case according to the present embodiment on an assumption that the attenuation resistor 60 has the resistance value of 1 kΩ. In the comparison example, attenuation of the circulation current Ic takes a long time because the current attenuation circuit 40 is not arranged. A time period from time t1 at which the power supply is turned off to time t2 at which the physical contact is turned off is 75 msec. In contrast, the circulation current Ic is attenuated rapidly in the present embodiment because of the arrangement of the current attenuation circuit 40. A time period from time t1 at which the power supply is turned off to time t2 at which the physical contact is turned off is 14 msec.

The present embodiment thus reduces a delay in a mechanical operation to turn off the power supply. It is preferable from a viewpoint of operating a machine at high speed.

(Modifications)

The attenuation resistor 60 is not necessarily required. The attenuation resistor 60 can be omitted when a necessary current attenuation can be achieved through avalanche allowable energy of the built-in diode 55.

A usual MOSFET may be used in place of the power MOSFET 50. In this case, an attenuation diode to be connected in the same manner as the built-in diode 55 in the power MOSFET 50 is used. The attenuation diode is connected between the source and the drain in the MOSFET. The attenuation diode also has a cathode connected on a side of the positive terminal TP, and an anode connected on a side of a negative terminal TN. Similar effects can be achieved through Such a configuration.

Figure 9:
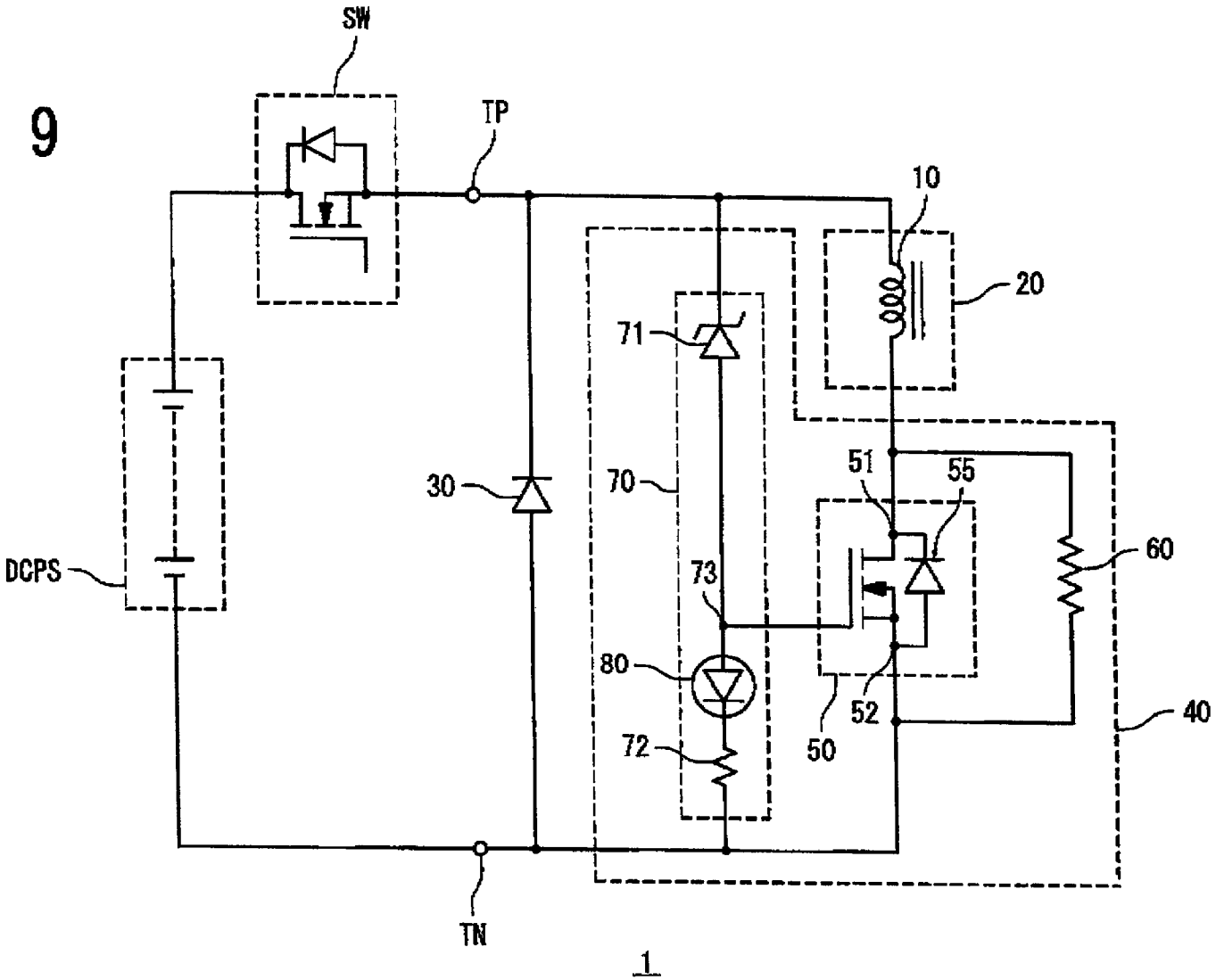
FIG. 9 is a circuit diagram showing a modification of the inductor driving circuit according to the present embodiment.

FIG. 9 shows a further modification. As shown in FIG. 9, the gate control circuit 70 may include a light emitting diode (LED) 80 connected in series to the resistor 72. In FIG. 9, the light emitting diode 80 is connected between the connection node 73 and the resistor 72. A resistance value of the resistor 72 is set to allow the light emitting diode 80 to emit light at a voltage between the gate and the source in the power MOSFET 50. The light emitting diode 80 plays a role of notifying a user of a normal operation by emitting light when the power supply is turned on. Brightness of the light emitting diode 80 depends on the DC driving voltage. Thus, by arranging the light emitting diode 80, the operation can be confirmed in accordance with a gate voltage condition. The number of components or parts can be reduced, including the light emitting diode 80 in the gate control circuit 70.

Figure 10:
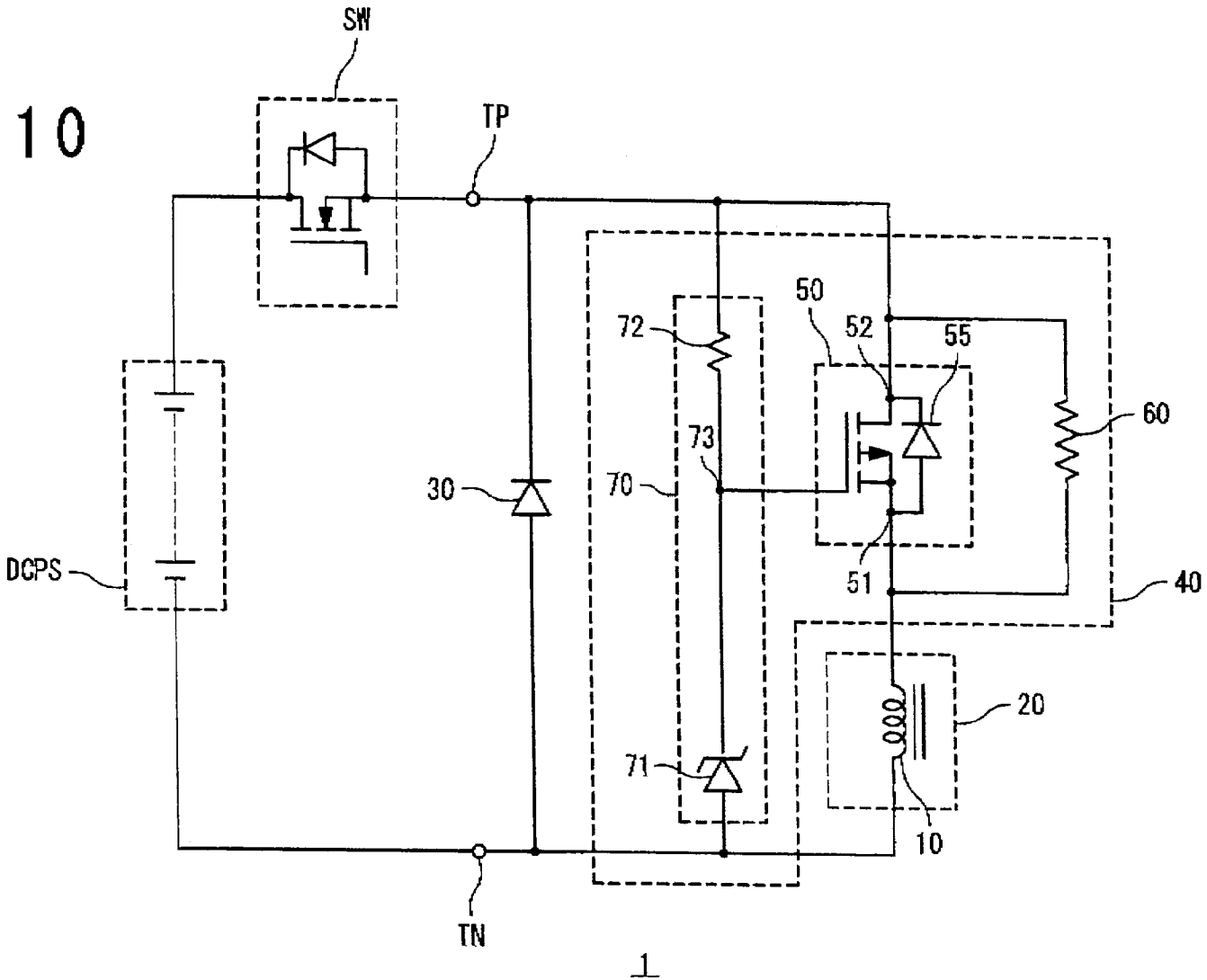
FIG. 10 is a circuit diagram showing another modification of the present embodiment.

Although the power MOSFET 50 of an N-channel type is exemplified in the above embodiment, the power MOSFET 50 of a P-channel type may also be used. FIG. 10 shows a case of using the power MOSFET 50 of a P-channel type. Similar operations and effects can be achieved through the configuration shown in FIG. 10.

A combination of the modifications shown above is also possible.

Description has been made above for the embodiments of the present invention with reference to the attached drawings. However, the present invention is not limited to the above present embodiments and can be modified appropriately by those who are skilled in the art without deviating from the gist.

What is claimed is:

1. An inductor driving circuit, comprising:

a positive terminal and a negative terminal, between which a DC voltage of a DC power supply is to be applied;

a switching element provided between said DC power supply and said positive terminal and configured to apply, when turned on, said DC voltage between said positive terminal and said negative terminal and to terminate, when turned off, the application of the DC voltage;

an inductor and a transistor connected in series between said positive terminal and said negative terminal;

a gate control circuit configured to turn on said transistor in response to the application of said DC voltage to form a current path through said switching element, said inductor and said transistor, and turn off said transistor in response to a termination of the application of said DC voltage;

a diode directly connected between a source and a drain of said transistor and having a cathode connected to said positive terminal and an anode connected to said negative terminal;

an attenuation resistor connected between said source and said drain of said transistor; and a feedback diode having a cathode connected to said positive terminal and an anode connected to said negative terminal to form an attenuation current loop through said inductor, said attenuation resistor, and said feedback diode, when the application of the DC voltage is terminated by said switching element.

2. The inductor driving circuit according to claim 1, wherein said transistor is a power transistor, and said diode is a diode built in said power transistor.

3. The inductor driving circuit according to claim 1, wherein said gate control circuit comprises:

a constant voltage diode and a resistor connected in series between said positive terminal and said negative terminal, and a gate terminal of said transistor is connected with a node between the constant voltage diode and the resistor.

4. The inductor driving circuit according to claim 3, wherein said gate control circuit further comprises:

a light emitting diode connected between said node and said resistor.

5. An inductor driving circuit, comprising:

a positive terminal and a negative terminal, between which a DC voltage of a DC power supply is to be applied;

a switching element provided between said DC power supply and said positive terminal and configured to apply, when turned on, said DC voltage between said positive terminal and said negative terminal and to terminate, when turned off, the application of the DC voltage;

an inductor and a transistor that are connected in series between said positive terminal and said negative terminal;

a gate control circuit configured to turn on said transistor in response to the application of said DC voltage to form a current path through said switching element, said inductor and said transistor, and turn off said transistor in response to a termination of the application of said DC voltage;

a diode directly connected between a source and a drain of said transistor, wherein a cathode of said diode is connected to one of said source and said drain of said transistor and an anode of said diode is connected to the other of said source and said drain of said transistor, and wherein said one of said source and said drain of said transistor is on a side of the positive terminal whereas the other of said source and said drain of said transistor is on a side of the negative terminal;

an attenuation resistor connected between said source and said drain of said transistor; and a feedback diode having a cathode connected to said positive terminal and an anode connected to said negative terminal to form an attenuation current loop through said inductor, said attenuation resistor, and said feedback diode, when the application of the DC voltage is terminated by said switching element, wherein said feedback diode and said diode are provided separately from each other and parallel to each other between said positive terminal and said negative terminal.

6. The inductor driving circuit according to claim 1, wherein said diode is configured to cause an avalanche breakdown when a voltage across the attenuation resistor exceeds an avalanche voltage of said diode.

7. The inductor driving circuit according to claim 5, wherein said diode is configured to cause an avalanche breakdown when a voltage across the attenuation resistor exceeds an avalanche voltage of said diode.

8. The inductor driving circuit according to claim 1, wherein said attenuation resistor is connected in parallel with both the transistor and the diode.

9. The inductor driving circuit according to claim 1, configured to cause, when the application of the DC voltage is terminated by said switching element, an attenuation current to flow along the attenuation current loop through said inductor, then through said attenuation resistor, then through said feedback diode and back to said inductor.

10. The inductor driving circuit according to claim 9, configured to cause, when said transistor is turned on, a current to flow along the current path through said switching element, then through said inductor, and then through said transistor.

11. The inductor driving circuit according to claim 5, wherein said attenuation resistor is connected in parallel with both the transistor and the diode.

12. The inductor driving circuit according to claim 11, configured to cause, when the application of the DC voltage is terminated by said switching element, an attenuation current to flow along the attenuation current loop through said inductor, then through said attenuation resistor, then through said feedback diode and back to said inductor.

13. The inductor driving circuit according to claim 12, configured to cause, when said transistor is turned on, a current to flow along the current path through said switching element, then through said inductor, and then through said transistor.

* * * * *